US010777926B2

(12) United States Patent
Cruble et al.

(10) Patent No.: US 10,777,926 B2
(45) Date of Patent: Sep. 15, 2020

(54) MULTI-CONTACT TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Thomas Cruble, Mie (JP); Junichi Mukuno, Mie (JP); Shingo Kobayashi, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/487,878

(22) PCT Filed: Feb. 2, 2018

(86) PCT No.: PCT/JP2018/003562
§ 371 (c)(1),
(2) Date: Aug. 22, 2019

(87) PCT Pub. No.: WO2018/155132
PCT Pub. Date: Aug. 30, 2018

(65) Prior Publication Data

US 2020/0059026 A1 Feb. 20, 2020

(30) Foreign Application Priority Data

Feb. 22, 2017 (JP) ..... 2017-031033

(51) Int. Cl.
*H01R 13/11* (2006.01)
*H01R 13/115* (2006.01)
(Continued)

(52) U.S. Cl.
CPC ..... *H01R 13/113* (2013.01); *H01R 13/111* (2013.01); *H01R 13/115* (2013.01); *H01R 13/187* (2013.01); *H01R 43/16* (2013.01)

(58) Field of Classification Search
CPC .... H01R 13/113; H01R 13/111; H01R 13/115
(Continued)

(56) References Cited

U.S. PATENT DOCUMENTS 3,363,224 A * 1/1968 Gluntz ..... H01R 13/11 439/852
3,381,262 A * 4/1968 Jeanrenaud ..... H01R 13/187 439/843
(Continued)

FOREIGN PATENT DOCUMENTS

JP 59-43084 3/1984
JP 63-87787 6/1988
(Continued)

OTHER PUBLICATIONS

International Search Report dated Mar. 27, 2018.

*Primary Examiner* — Alexander Gilman
(74) *Attorney, Agent, or Firm* — Gerald E. Hespos; Michael J. Porco; Matthew T. Hespos

(57) ABSTRACT

A multi-contact terminal includes a polygonal tube with side walls. Front resilient contact pieces extend from front ends of the side walls in a connecting direction to a mating terminal. The front resilient contact pieces are folded rearward by front folded portions and are to be brought resiliently into contact with an outer peripheral surface of the mating terminal inside the polygonal tube. Rear resilient contact pieces extend from rear ends of the side walls in the connecting direction. The rear resilient contact pieces are folded forward by rear folded portions and are to be brought resiliently into contact with the outer peripheral surface of the mating terminal inside the polygonal tube. The polygo-
(Continued)

nal tube, the front resilient contact pieces and the rear resilient contact pieces are integral with one another.

4 Claims, 5 Drawing Sheets

(51) Int. Cl.
*H01R 13/187* (2006.01)
*H01R 43/16* (2006.01)

(58) Field of Classification Search
USPC ..... 439/852
See application file for complete search history.

(56) References Cited

U.S. PATENT DOCUMENTS 3,713,080 A * 1/1973 Kennedy ..... H01R 13/113 439/852
3,786,401 A * 1/1974 Jones ..... H01R 13/114 439/852
4,753,616 A * 6/1988 Molitor ..... H01R 13/187 439/787
4,906,200 A * 3/1990 Miyake ..... H01R 31/06 439/101
5,041,024 A * 8/1991 Liu ..... H01R 13/6593 439/654
5,203,813 A * 4/1993 Fitzsimmons ..... H01R 13/187 29/876
5,658,171 A * 8/1997 Pauza ..... H01R 13/5202 439/675
5,890,936 A * 4/1999 McDonald ..... H01R 13/114 439/852
6,065,997 A * 5/2000 Wang ..... H01R 24/542 439/578
6,899,563 B1 * 5/2005 Lee ..... H01R 24/40 439/578
6,899,571 B1 * 5/2005 Koch ..... H01R 4/4881 439/843
8,021,200 B2 * 9/2011 Myer ..... H01R 13/113 439/857
8,668,531 B2 * 3/2014 Yamaguchi ..... H01R 13/187 439/845
8,702,456 B1 * 4/2014 Wang ..... H01R 9/0503 439/578
8,827,754 B2 * 9/2014 Lee ..... H01R 13/113 439/843
8,827,756 B2 * 9/2014 Mueller ..... H01R 13/112 439/852
9,601,856 B2 * 3/2017 Regantini ..... H02B 11/04
9,716,332 B1 * 7/2017 Wimmer ..... H01R 13/03
9,799,969 B2 * 10/2017 Lee ..... H01R 4/60
9,837,745 B2 * 12/2017 Sasaki ..... H01R 13/113
9,985,376 B2 * 5/2018 Zhang ..... H01R 13/187
10,044,146 B2 * 8/2018 Adrian ..... H01R 13/648
10,164,365 B2 * 12/2018 Hashiguchi ..... H01R 13/113
10,218,105 B2 * 2/2019 Stange ..... H01R 13/50
10,256,560 B2 * 4/2019 Fertig ..... H01R 13/18
10,305,213 B1 * 5/2019 Hirakawa ..... H01R 13/187
2003/0068931 A1 * 4/2003 Swearingen ..... H01R 13/187 439/843
2004/0003498 A1 * 1/2004 Swearingen ..... H01R 13/187 29/862
2004/0033732 A1 * 2/2004 Koch, Jr. ..... H01R 13/187 439/843
2013/0143452 A1 * 6/2013 Yoshikawa ..... H01R 13/187 439/863
2016/0285187 A1 * 9/2016 Oba ..... H01R 4/023

FOREIGN PATENT DOCUMENTS

| | | |
|---|---|---|
| JP | 4-61775 | 5/1992 |
| JP | 2011-54330 | 3/2011 |
| JP | 2013-120653 | 6/2013 |
| JP | 2015-099698 | 5/2015 |
| JP | 2016-81561 | 5/2016 |

* cited by examiner

MULTI-CONTACT TERMINAL

BACKGROUND

Field of the Invention

The present invention relates to a multi-contact terminal.

Related Art

Japanese Unexamined Patent Publication No. 2015-99698 discloses a multi-contact terminal to be brought into contact with a mating terminal on many contact points and is used in an electric vehicle or the like. This terminal is configured such that cantilevered resilient contact pieces extend forward from the front end edge of an angular tube and are folded rearward into the angular tube for contacting the outer peripheral surface of a rod-like round pin having a circular cross-section.

Associated with an increase of a current in a power supply path, a demand for suppressing the amount of heat generation of a terminal is being increased. It is considered to increase a plate thickness of the terminal to reduce electrical resistance, but the resilient contact pieces are enlarged to cause a problem of enlarging the terminal itself if the plate thickness is increased.

Further, if a wire becomes thicker, a connected state to the mating terminal may become unstable due to vibration received from the wire. Thus, a more stable connected state is desired.

The invention was completed on the basis of the above situation and an object thereof is to provide a multi-contact terminal configured to bring resilient contact pieces into contact with a mating terminal, hardly inclined even when receiving vibration from a wire and capable of suppressing the amount of heat generation.

SUMMARY

A multi-contact terminal in accordance with an embodiment of the invention includes a polygonal tube with a plurality of side walls. Front resilient contact pieces extend from front ends of the side walls in a connecting direction to a mating terminal and are folded rearward at front folds. The front resilient contact pieces resiliently contacting an outer peripheral surface of the mating terminal inside the polygonal tubeRear resilient contact pieces extend from rear ends of the side walls in the connecting direction and are folded forward at rear folds. The rear resilient contact pieces resiliently contact the outer peripheral surface of the mating terminal inside the polygon tube. The polygonal tube, the front resilient contact pieces and the rear resilient contact pieces are integral with one another.

According to the above configuration, the multi-contact terminal includes the front and rear resilient contact pieces on front and rear ends of the side walls of the polygonal tube with respect to the connecting direction to the mating terminal. Thus, the multi-contact terminal can contact the mating terminal at positions different in a length direction, i.e. the connecting direction. Specifically, a posture relative to the mating terminal is maintained more easily as compared to a conventional configuration in which resilient contact pieces are provided on side walls only on one end. Thus, the multi-contact terminal is less likely to incline during a connection operation to the mating terminal or upon receiving vibration from a wire so that a connected state can be maintained stably. Further, there are more contact points with the mating terminal than before. Thus, contact resistance decreases, and the amount of heat generation of the terminals can be suppressed.

The front and rear resilient contact pieces may have the same dimensions and the same shape, and the front resilient contact pieces or the rear resilient contact pieces may be disposed at positions different in the connecting direction. When fitting the terminals to each other, insertion resistance is largest when the mating terminal thrusts itself between the resilient contact pieces of the multi-contact terminal. According to the above configuration, since the front resilient contact pieces and/or the rear resilient contact pieces contact the mating terminal at the positions different in the length direction, i.e. the connecting direction. Thus, insertion resistance during a fitting operation can be reduced as compared to a configuration in which the resilient contact pieces contact the mating terminal at the same position. In addition, since the front and rear resilient contact pieces have the same dimensions and the same shape, a contact pressure of each resilient contact piece with the mating terminal can be made equal.

The tube may be provided with forward expanding portions adjacent to base end parts of the front resilient contact pieces and extending along an extending direction of the front resilient contact pieces. By adopting this configuration, the rigidity of the base end parts of the front resilient contact pieces is increased by the forward expanding portions. Therefore the deformation of the base end parts of the front resilient contact pieces by being pressed by the mating terminal is suppressed when the mating terminal is inserted.

The forward expanding portions may extend farther forward than the front folded portions. By adopting this configuration, even if the mating terminal or a device butts against the multi-contact terminal from the front, the front folded portions are protected by the forward expanding portions extending forward. Thus, the deformation of the front resilient contact pieces can be suppressed.

The tube may be formed by fixing end edges of a plate-like member bent into a polygonal tube shape to each other. By adopting this configuration, the multi-contact terminal can be produced easily.

According to the present invention, it is possible to obtain a multi-contact terminal hardly inclined even when receiving vibration from a wire and capable of suppressing the amount of heat generation.

DETAILED DESCRIPTION

Hereinafter, one embodiment is described in detail with reference to FIGS. 1 to 5.

Figure 2:
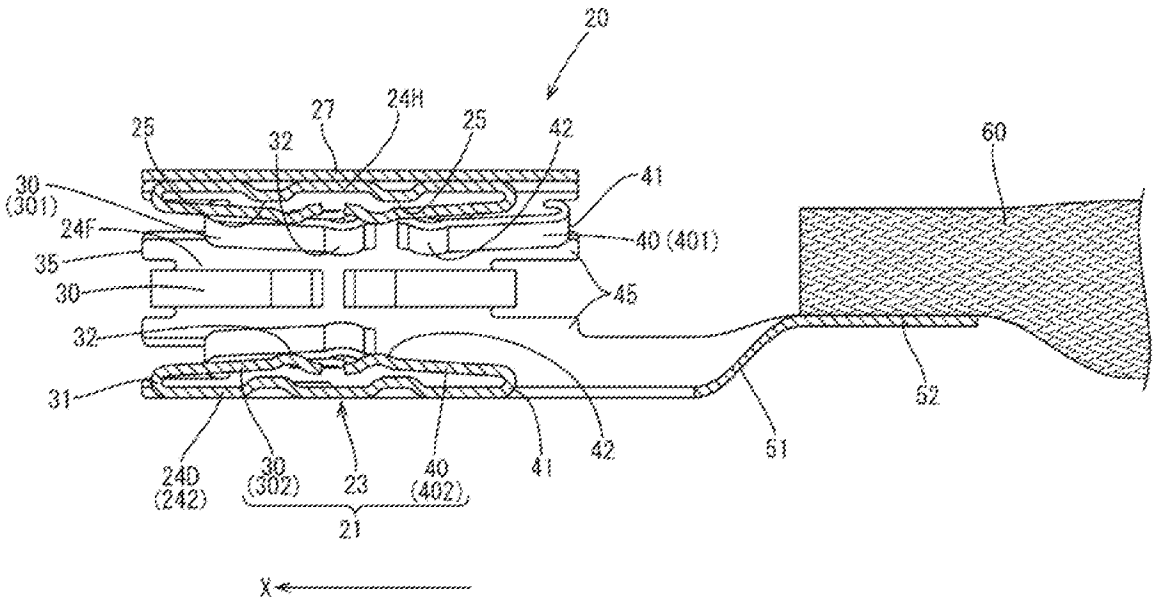
FIG. 2 is a section of the multi-contact terminal.
Figure 3:
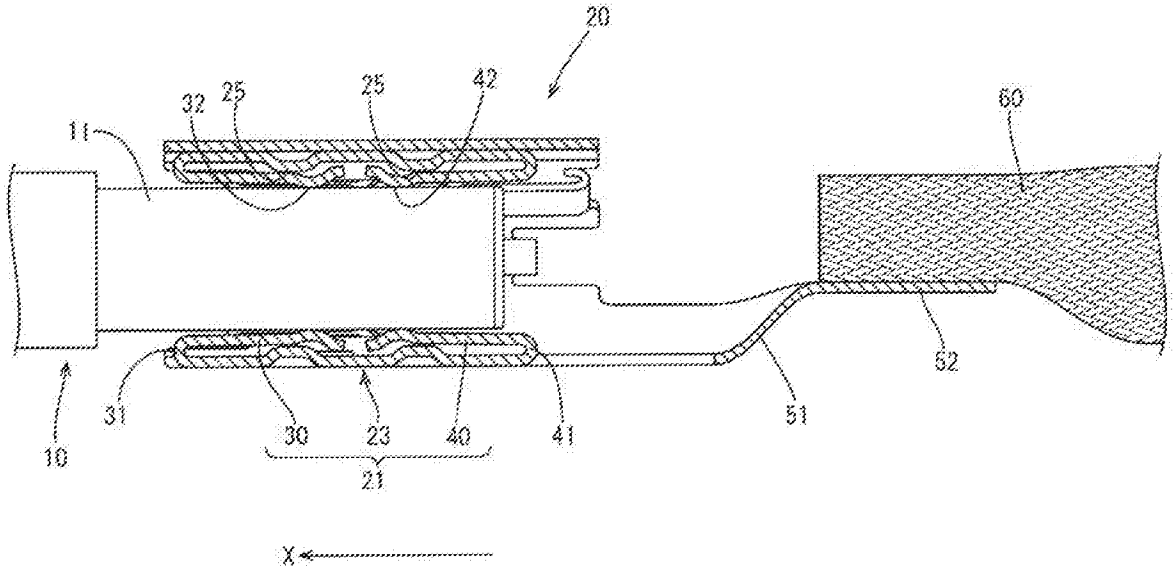
FIG. 3 is a section showing a state where the multi-contact terminal is connected to a mating terminal.

A multi-contact terminal of this embodiment is a large current terminal used in a power supply line or the like of an electric vehicle, a hybrid vehicle or the like. As shown in FIG. 3, the multi-contact terminal is a female terminal 20 into which a mating male terminal 10 in the form of a round rod having a uniform diameter is fit, and is configured such that resilient contact pieces 30, 40 of the female terminal 20 are brought into contact with the outer peripheral surface of the male terminal 10. In the following description, a connecting direction X to the mating terminal is referred to as a forward direction and upper and lower sides of FIG. 2 are referred to as upper and lower sides in each constituent member.

The male terminal 10 is formed of a metal material excellent in conductivity, such as copper alloy. One end of the male terminal 10 is connected to an unillustrated wire and the other end thereof serves as a connecting portion 11 in the form of a round rod (see FIG. 3).

Figure 1:
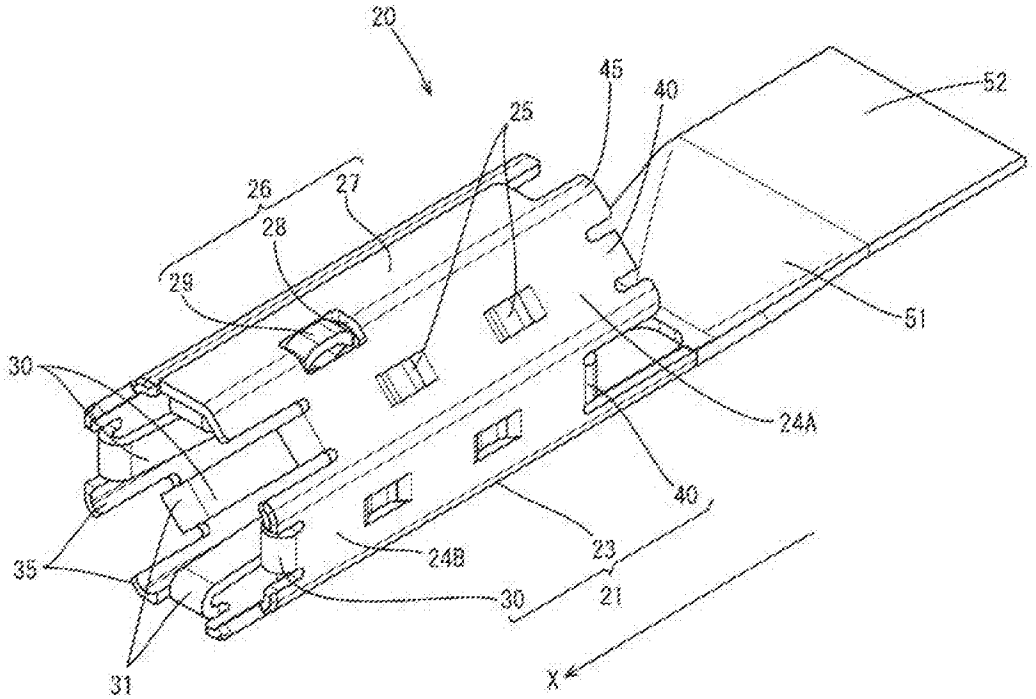
FIG. 1 is a perspective view of a multi-contact terminal of one embodiment.

The female terminal 20 is formed from a metal material excellent in conductivity, such as copper alloy, that is press-worked into a predetermined shape. As shown in FIGS. 1 and 2, a body 21 to be connected to the connecting portion 11 of the male terminal 10 and a wire connecting portion 52 to be connected to a wire 60 are connected one after the other via a link 51.

The body 21 includes an octagonal tube 23 with eight front resilient contact pieces 30 integrally extending forward from an end edge on a front of the tube 23 and folded rearwardly and inwardly, and six rear resilient contact pieces 40 integrally extending rearward from an end edge on a rear of the tube 23 and folded forwardly and inwardly.

Figure 5:
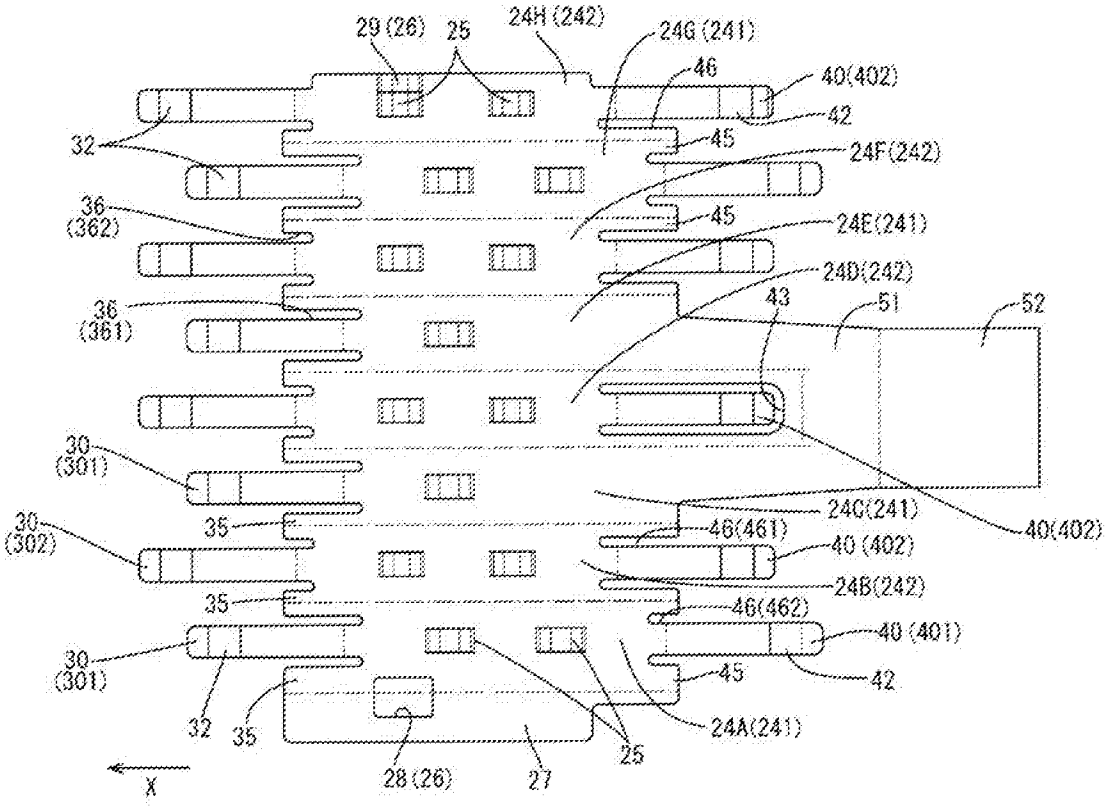
FIG. 5 is a development of the multi-contact terminal.

The tube 23 is formed into a substantially octagonal tube shape with eight side walls 24 by bending a flat metal plate stamped into a development shape, as shown in FIG. 5, by a press forming machine and preventing both end parts in a bending direction from being opened by a locking portion 26. The eight side walls are denoted successively by 24A, 24B, 24C, 24D, 24E, 24F, 24G and 24H from a lower side of FIG. 5, and denoted by 24 when being not distinguished.

The locking portion 26 is composed of a locking hole 28 provided in a locking piece 27 extending from the side wall 24A on one end in the bending direction of the metal plate and a locking protrusion 29 projecting radially out of the tube 23 on the side wall 24H on the other end. The locking hole 28 is at a position straddling over a bending line indicated by a broken line in FIG. 5. Further, the locking protrusion 29 is formed by cutting and raising an end part of the side wall 24H radially outward of the angular tube 23 (see FIG. 1).

As shown in FIG. 5, the angular tube 23 of this embodiment is configured by alternately shifting adjacent side walls 24A to 24H in a front-rear direction. Specifically, the side walls 24A, 24C, 24E and 24G are first side walls 241 disposed near a rear end (near a right end of FIG. 5), and the side walls 24B, 24D, 24F and 24H are second side walls 242 disposed near a front end (near a left end of FIG. 5). The first side walls 241 and the second side walls 242 have equal length (lateral dimension in FIG. 5) and width (vertical dimension in FIG. 5).

The link 51 extends continuously rearward from the rear end of the side walls 24C, 24D and 24E, and the wire connecting portion 52 is a flat plate that extends rearward from the rear end of the link 51 (see FIGS. 1 and 5). The wire 60 is welded to the wire connecting portion 52. Further, the rear resilient contact piece 40 to be described later is cut out by a U-shaped slit 43 in an area of the link 51 connected to and behind the side wall 24D.

The strip-like front resilient contact pieces 30 having a width about half the width of the side walls 24 extend forward from widthwise central parts of the front end edges of the respective side walls 24A to 24H of the polygonal tube 23, and are folded inwardly and rearwardly of the tube 23 at front folded portions 31. As shown in FIG. 2, rear parts of the front resilient contact pieces 30 extend obliquely inward to approach each other, and front contacts 32 bulge inward with arcuate cross-section at positions near the rear parts. The front contacts 32 are to be brought into contact with the connecting portion 11 of the male terminal 10.

Further, the rear resilient contact pieces 40 are provided on the rear ends of the side walls 24 not provided with the link 51, i.e. the side walls 24A, 24B, 24F, 24G and 24H of the polygonal tube 23, and on the side wall 24D located in a middle, out of three side walls 24 provided with the link 51. The rear resilient contact piece 40 of the side wall 24D is cut out by providing the U-shaped cutting slit 43 in the link 51 as described above. The cutting slit 43 is at a position where the rear resilient contact piece 40 of the side wall 24D is disposed at the same position as the rear resilient contact pieces 40 of the side walls 24B, 24F and 24H in the front-rear direction.

The rear resilient contact pieces 40 have the same shape as the front resilient contact pieces 30. Specifically, as shown in FIG. 2, front ends of the rear resilient contact pieces 40 extend obliquely in toward the front to approach each other, and rear contacts 42 bulge in with arcuate cross-sections at positions near tips that are to be brought into contact with the connecting portion 11 of the male terminal 10.

The eight front resilient contact pieces 30 and the six rear resilient contact pieces 40 are shaped identically to have the same length in the front-rear direction, width, bent shape and the like. Specifically, front first resilient contact pieces 301 of the first side walls 241 (side walls 24A, 24C, 24E and 24G) are shifted rearward from front second resilient contact pieces 302 of the second side walls 242 (24B, 24D, 24F and 24H). Further, rear first resilient contact pieces 401 of the first side walls 241 (side walls 24A, 24C, 24E and 24G) are shifted rearward from rear second resilient contact pieces 402 of the second side walls 242 (24B, 24D, 24F and 24H).

Lengths of the front resilient contact pieces 30, the rear resilient contact pieces 40 and the side walls 24 are set so that the tip parts of these front resilient contact pieces 30 and rear resilient contact pieces 40 do not touch each other.

Each side wall 24A to 24H is formed with one or two restricting protrusions 25 projecting radially inward by cutting and raising (see FIG. 2). Specifically, each of the side walls 24A, 24B, 24D, 24F, 24G and 24H is provided with two of the restricting protrusions 25, and each of the side walls 24C, 24E is provided with one restricting protrusion 25. These restricting protrusions 25 restrict excessive deformation of the front resilient contact pieces 30 and the rear resilient contact pieces 40.

The front restricting protrusion 25 or the one restricting protrusion 25 of one side wall 24 is provided somewhat in front of a position of the side wall 24 facing the front contact 32. Further, the rear restricting protrusion 25 of one side wall 24 is provided somewhat behind a position of the side wall 24 facing the rear contact 42. Specifically, the restricting protrusions 25 are at positions in contact with somewhat base ends of the contacts 32, 42 of the resilient contact pieces 30, 40.

Forward expanding portions 35 extend forward at positions between base ends of adjacent ones of the front resilient contact pieces 30 in a developed state, shown in FIG. 5 on the front of the polygonal tube 23. Further, a forward expanding portion 35 is provided on a base end part of the front resilient contact piece 30 of the side wall 24A on the side of the locking piece 27. The locking piece 27 is integrated with this forward expanding portion 35 by extending to have a length equal to this forward expanding portion 35. The front ends of these forward expanding portions 35 and the locking piece 27 are arranged on the same line. More particularly, lengths of front slits 36 provided between one forward expanding portion 35 and the adjacent front resilient contact pieces 30 differ on both sides of the forward expanding portion 35, and a length of a first slit 361 located on the side of the first side wall 241 is longer than that of a second slit 362 located on the side of the second side wall 242. By making the lengths of the slits 36 different in this way, the front resilient contact pieces 30 are located at positions different in the front-rear direction.

Similarly, rearward expanding portions 45 extend rearward at positions between extending end parts of adjacent rear resilient contact pieces 40 in the developed state shown in FIG. 5 on the rear end of the polygonal tube 23. Further, a rearward expanding portion 45 also is provided on a base end part of the rear resilient contact piece 40 of the side wall 24A on the side of the locking piece 27. The locking piece 27 is integrated with this rearward expanding portion 45 by extending to have a length equal to this rearward expanding portion 45, but a corner part on a right-lower end of the locking piece 27 in FIG. 5 is cut rectangularly to allow the rear resilient contact piece 40 of the side wall 24H to escape. Note that no rearward expanding portion 45 is provided between the side walls 24C and 24D and between the side walls 24D and 24E, the link 51 extending from the side walls 24C, 24D and 24E. The rear ends of a total of six rearward expanding portions 45 are arranged on the same line. The rear resilient contact pieces 40 also are located at positions different in the front-rear direction by making the lengths of rear slits 46 provided between adjacent ones of the rear resilient contact pieces 40 different.

Figure 4:
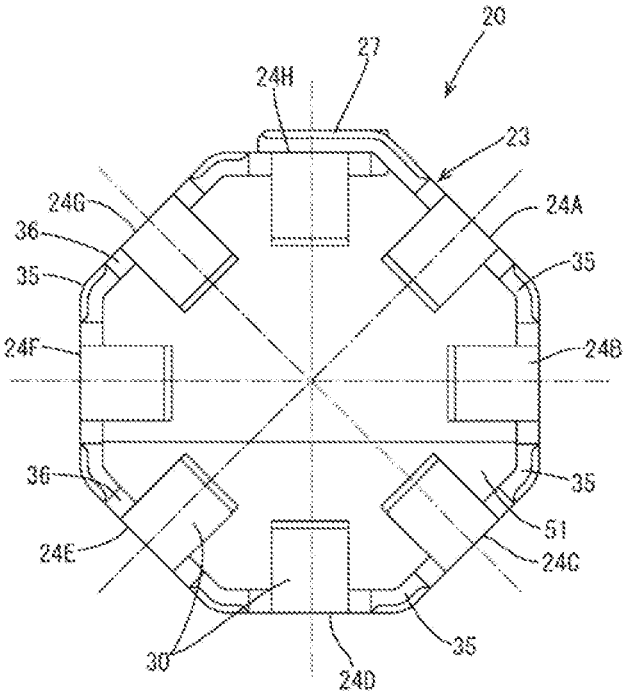
FIG. 4 is a front view of the multi-contact terminal.

The polygonal tube 23 is folded along the front-rear direction (along broken lines of FIG. 5) on these expanding portions 35, 45 into a substantially octagonal tube shape (see FIG. 4).

Note that the tips of the forward expanding portions 35 are more forward than the front folded portions 31 of the front resilient contact pieces 30 described above. Further, the tips of the rearward expanding portions 45 are more rearward than rear folded portions 41 of the rear resilient contact pieces 40 described above (see FIG. 2).

The female terminal 20 of this embodiment is configured as described above. Next, a method for producing the female terminal 20 is described.

First, the respective resilient contact pieces 30, 40 are formed into a predetermined shape by bending (press-working) parts corresponding to the front resilient contact pieces 30 and the rear resilient contact pieces 40 of the metal plate stamped into a predetermined shape. The stamped metal plate is bent along the front-rear direction at positions corresponding to the forward expanding portions 35 and the rearward expanding portions 45 to form the polygonal tube 23, the locking piece 27 is bent to cover the locking protrusion 29 formed on one end in the bending direction from an outer side, and the locking protrusion 29 is fit into the locking hole 28 for locking and preventing opening. Further, the link 51 is bent together with the polygonal tube 23. In this way, the female terminal 20 having a predetermined shape shown in FIG. 1 is obtained.

Next, a connecting operation of the male terminal 10 and the female terminal 20 and functions and effects are described.

First, when the connecting portion 11 of the male terminal 10 is inserted into the body 21 of the female terminal 20 having the wire 60 connected to the wire connecting portion 52 by resistance welding, the connecting portion 11 thrusts itself between the front contact portions 32 of two pairs of (four) front second resilient contact pieces 302 disposed diagonally while resiliently displacing the front second resilient contact pieces 302 and subsequently the front first resilient contact pieces 301 outward.

At this time, the forward expanding portions 35 extending from the polygonal tube 23 are provided between adjacent front resilient contact pieces 30 and rigidity is imparted to the base end parts of the respective front resilient contact pieces 30 by these forward expanding portions 35. Thus, the base end parts of the front resilient contact pieces 30 are lifted and pushed to a back side of the polygonal tube 23 as the connecting portion 11 is inserted.

When the connecting portion 11 is inserted farther back, the connecting portion 11 successively thrusts itself between the front contact portions 32 of the front first resilient contact pieces 301, between the rear contact portions 42 of the rear second resilient contact pieces 402 and between the rear contact portions 41 of the rear first resilient contact pieces 401.

When the connecting portion 11 is inserted to a proper position in the polygonal tube 23, the connecting portion 11 is successively sandwiched by four front second resilient contact pieces 302, four front first resilient contact pieces 301, four rear second resilient contact pieces 402 and two rear first resilient contact pieces 401, with the resilient contact pieces being located at positions shifted from each other by 45°. In this way, the male and female terminals 10, 20 are connected electrically (see FIG. 3).

As just described, since the resilient contact pieces are provided not only on the front, but also on the rear of the polygonal tube 23 according to the female terminal 20 of this embodiment, the resilient contact pieces can contact the connecting portion 11 of the male terminal 10 at the positions different in the front-rear direction, i.e. the connecting direction X and hold the connecting portion 11 in the body 21. Since a posture of the female terminal 20 relative to the male terminal 10 easily is maintained as just described, the female terminal 20 is not inclined during a connecting operation or upon receiving vibration from the wire 60 and a connected state to the male terminal 10 can be maintained stably.

Further, there are more contact points with the male terminal 10 than before. Thus, contact resistance decreases, and the amount of heat generation of the female terminal 20 can be suppressed. Further, since a conductive path between the rear resilient contact pieces 40 and the wire 60 is shorter than that between the front resilient contact pieces 30 and the wire 60, the amount of heat generation can be suppressed further.

Further, since the front resilient contact pieces 30 and the rear resilient contact pieces 40 are at the positions different in the connecting direction X, insertion resistance during a fitting operation becomes smaller and workability during a connecting operation is improved. In addition, all of the front resilient contact pieces 30 and the rear resilient contact pieces 40 have the same dimensions and the same shape. Thus, a contact pressure with the male terminal 10 can be made equal at all the contact portions 32, 42.

Further, the polygonal tube 23 is provided with the forward expanding portions 35 adjacent to the base end parts of the front resilient contact pieces 30 and extending along an extending direction of the front resilient contact pieces 30. Thus, the rigidity of the base end parts of the front resilient contact pieces 30 is increased and the base end parts of the front resilient contact pieces 30 will not be deformed by the male terminal 10 when the male terminal 10 is inserted.

Further, tips of the forward expanding portions 35 extend farther forward than the front folded portions 31 of the front resilient contact pieces 30. Thus, the front folded portions 31 of the front resilient contact pieces 30 can be protected to prevent deformation even if a device butts against the female terminal 20 from the front or the male terminal 10 butts against the female terminal 20 in a direction different from the connecting direction X.

Further, since the female terminal 20 is formed by bending one metal plate and simply configured by locking the end parts in the bending direction to each other by the locking portion 26, the female terminal 20 can be produced easily. Furthermore, since dimensions are easily controlled with bending, the contact pressure is adjusted easily.

The invention is not limited to the above described and illustrated embodiment. For example, the following embodiments also are included in the scope of the invention.

Although the front resilient contact pieces 30 and the rear resilient contact pieces 40 are shifted in the front-rear direction in the above embodiment, these resilient contact pieces may be disposed at the same positions.

Although all of the front resilient contact pieces 30 and the rear resilient contact pieces 40 have the same dimensions and the same shape in the above embodiment, these resilient contact pieces may have different dimensions and/or different shapes.

Although the polygonal tube 23 of the female terminal 20 is prevented from being opened by locking the end edges in the bending direction to each other by the locking portion 26 in the above embodiment, this configuration is not always necessary. The opening may be prevented, for example, by welding or the like.

The expanding portions 35, 45 may not be provided.

The forward expanding portions 35 may not extend farther forward than the front folded portions 31.

Although the resilient contact pieces 30, 40 extend from ends of all the side walls provided with the link 51 in the above embodiment, the resilient contact pieces 30, 40 may extend only from selected side wall(s).

Although the polygonal tube 23 having a substantially octagonal tube shape is shown in the above embodiment, the polygonal tube may have a polygonal tube shape having three or more angles. Note that the polygonal tube preferably has a polygonal shape having an even number of angles.

Although the contact portions 32, 42 of the resilient contact pieces 30, 40 are provided at two positions in the front-rear direction in the above embodiment, the contact portions 32, 42 may be provided at three or more positions in the front-rear direction.

Although the female terminal 20 and the wire 60 are connected by resistance welding in the above embodiment, a connection method is not limited to that of the above embodiment. For example, another connection method such as crimping or ultrasonic welding may be adopted.

LIST OF REFERENCE SIGNS

10 . . . male terminal (mating terminal)
20 . . . female terminal (multi-contact terminal)
23 . . . angular tube portion
24 . . . side wall
26 . . . locking portion
27 . . . locking piece
28 . . . locking hole
29 . . . locking protrusion
30 . . . front resilient contact piece
31 . . . front folded portion
35 . . . forward expanding portion
40 . . . rear resilient contact piece
41 . . . rear folded portion
45 . . . rearward expanding portion
X . . . connecting direction (forward)

The invention claimed is:

1. A multi-contact terminal, comprising:

a polygonal tube with a plurality of side walls;

a plurality of front resilient contact pieces extending from front end edges of the side walls in a connecting direction to a mating terminal, folded rearward by front folded portions and to be brought resiliently into contact with an outer peripheral surface of the mating terminal inside the polygonal tube; and a plurality of rear resilient contact pieces extending from rear end edges of the side walls in the connecting direction, folded forward by rear folded portions and to be brought resiliently into contact with the outer peripheral surface of the mating terminal inside the polygonal tube;

the polygonal tube, the front resilient contact pieces and the rear resilient contact pieces being integral with one another;

wherein:

the side walls have the same width and the same length from base end parts of the front resilient contact pieces to base end parts of the rear resilient contact pieces and the front resilient contact pieces and the rear resilient contact pieces have the same dimensions and the same shape; and the front resilient contact pieces are disposed at positions different in the connecting direction and the rear resilient contact pieces also are disposed at positions different in the connecting direction by shifting the of side walls in the connecting direction.

2. The multi-contact terminal of claim 1, wherein the polygonal tube is provided with forward expanding portions adjacent to base end parts of the front resilient contact pieces and extending along an extending direction of the front resilient contact pieces.

3. The multi-contact terminal of claim 2, wherein the forward expanding portions extend farther forward than the front folded portions.

4. The multi-contact terminal of claim 1, wherein the polygonal tube is formed by fixing end edges of a plate-like member bent into an polygonal tube shape to each other.

* * * * *